US006929328B1

(12) United States Patent
Snyder

(10) Patent No.: US 6,929,328 B1
(45) Date of Patent: Aug. 16, 2005

(54) CHAIR RAISER

(76) Inventor: Donald W. Snyder, 306 S. Woodlawn, Long Grove, IA (US) 52756

( * ) Notice: Subject to any disclaimer, the term of this patent is extended or adjusted under 35 U.S.C. 154(b) by 0 days.

(21) Appl. No.: 10/761,555

(22) Filed: Jan. 21, 2004

(51) Int. Cl.[7] ..... A47B 97/00

(52) U.S. Cl. ..... 297/463.1; 297/130; 297/344.12; 248/188.2; 248/346.06; 5/509.1

(58) Field of Search ..... 297/463.1, 130, 297/344.12, 463.2, DIG. 10; 248/188.2, 248/346.01, 346.02, 346.03, 346.06; 108/144; 5/509.1

(56) References Cited

U.S. PATENT DOCUMENTS 1,367,390 A * 2/1921 Hinson ..... 297/133
2,545,949 A * 3/1951 Fox ..... 312/351.3
3,215,382 A * 11/1965 Stein ..... 248/172
3,952,983 A 4/1976 Crochet
4,616,873 A 10/1986 Debo
5,224,227 A * 7/1993 McGinley ..... 5/509.1
5,251,960 A 10/1993 Anderson
5,333,825 A 8/1994 Christensen
5,725,188 A 3/1998 Monteiro, Jr.
5,899,422 A * 5/1999 Eke ..... 248/188.4
6,575,414 B2 * 6/2003 Cuzzocrea ..... 248/188.2

* cited by examiner

*Primary Examiner*—Laurie K. Cranmer
(74) *Attorney, Agent, or Firm*—Sturm & Fix LLP

(57) ABSTRACT

Elderly and handicapped persons may have difficulty exiting some chairs. Raising the chair off the floor a few inches may make it easier for such a person to remove themselves from the chair. A chair elevating device is disclosed, having a raised surface on which to set a chair's legs and removable pegs. The removable pegs can be removed to accommodate the chair's legs and transverse cross members while helping to secure the chair to the chair raising device.

12 Claims, 4 Drawing Sheets

CHAIR RAISER

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates generally to an aid for handicapped persons. More particularly the present invention relates to a device for raising a chair to make it easier for a handicapped person to exit the chair.

2. Background Art

It is often the case that chairs are too low for a handicapped person to easily exit from them. Some devices to remedy this situation use electric actuators to lift and tilt a chair for the elderly person to exit more easily. Other, more basic devices, simply raise a chair higher than it normally sits and require no power, electrical or otherwise. U.S. Patents issued to Anderson (U.S. Pat. No. 5,251,960), Monteiro, Jr. (U.S. Pat. No. 5,725,188), Christensen (U.S. Pat. No. 5,333,825), and Crochet (U.S. Pat. No. 3,952,983) all disclose structure for elevating a chair above a floor.

It is stated in the Anderson '960 patent, "the auxiliary booster frame provides an inexpensive and reliable way of raising the chair to make it easier for people to get into and out of the chair, and requires no moving parts or electrical connections."

The Monteiro, Jr. '188 patent discloses a support pad with an upstanding elevation block having an elongated groove formed in its top surface. U-shaped legs of lawn chairs are received in the groove. Also provided are "blind holes" for supporting lawn chairs having vertical tubular legs.

None of the above patents discloses a chair raiser having removable pegs for accommodating chair legs and/or transverse cross members under the chair. Furthermore, there is no motivation or teaching in the prior art of a chair raiser having removable pegs for securing chair legs and allowing clearance for cross member supports which may be present in some chairs.

There is, therefore, a need for a simple, unpowered device for elevating a chair; the device having removable pegs for accommodating the chair's legs or cross members. There is a further need for such a device having sufficient pegs are provided to permit use with many chair makes and models.

BRIEF SUMMARY OF THE INVENTION

A purpose of this invention is to provide a method and device for elevating a chair to aid an elderly or handicapped person in exiting the chair. An additional purpose of this invention is for a device having a plurality of removable pegs such that appropriate pegs can be removed to accommodate chairs' transverse cross members and legs, etc. as needed.

The present invention comprises two elongated members, one for each side of the chair. Each of the elongated members has an elevated flat surface that is enclosed on three sides. The enclosed sides are at the front, back and side of the chair. The side of the flat surface toward the underside of the chair is open. A row of removable pegs is provided along the open side of the flat surface. Removing appropriate pegs allows room for chair legs and/or transverse cross members that would otherwise preclude the use of such a chair raiser. The remaining pegs may provide additional stability as they bear against the chair's legs and/or cross members, thus not permitting the chair to move or slide forward or back.

In a first embodiment, the three enclosed sides of the flat surface are enclosed by a solid wall. In a second embodiment, the enclosed sides are lined with additional pegs, some or all of which may also be removable.

The device of the present invention may be made of high-impact or other plastic, metals of many types and configurations, hard rubber, or wood. The present invention is not limited to any particular material of construction.

The novel features which are believed to be characteristic of this invention, both as to its organization and method of operation together with further objectives and advantages thereto, will be better understood from the following description considered in connection with the accompanying drawings in which a presently preferred embodiment of the invention is illustrated by way of example. It is to be expressly understood however, that the drawings are for the purpose of illustration and description only and not intended as a definition of the limits of the invention.

DETAILED DESCRIPTION OF THE INVENTION

Figure 1:
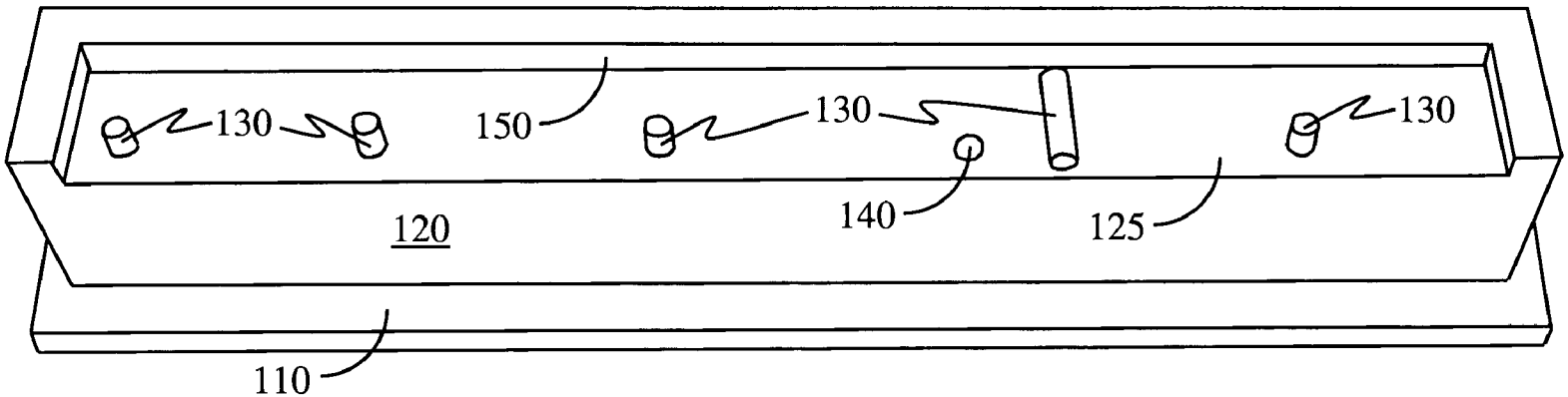
FIG. 1 is a perspective view of the chair raiser of the present invention having removable pegs.
Figure 2:
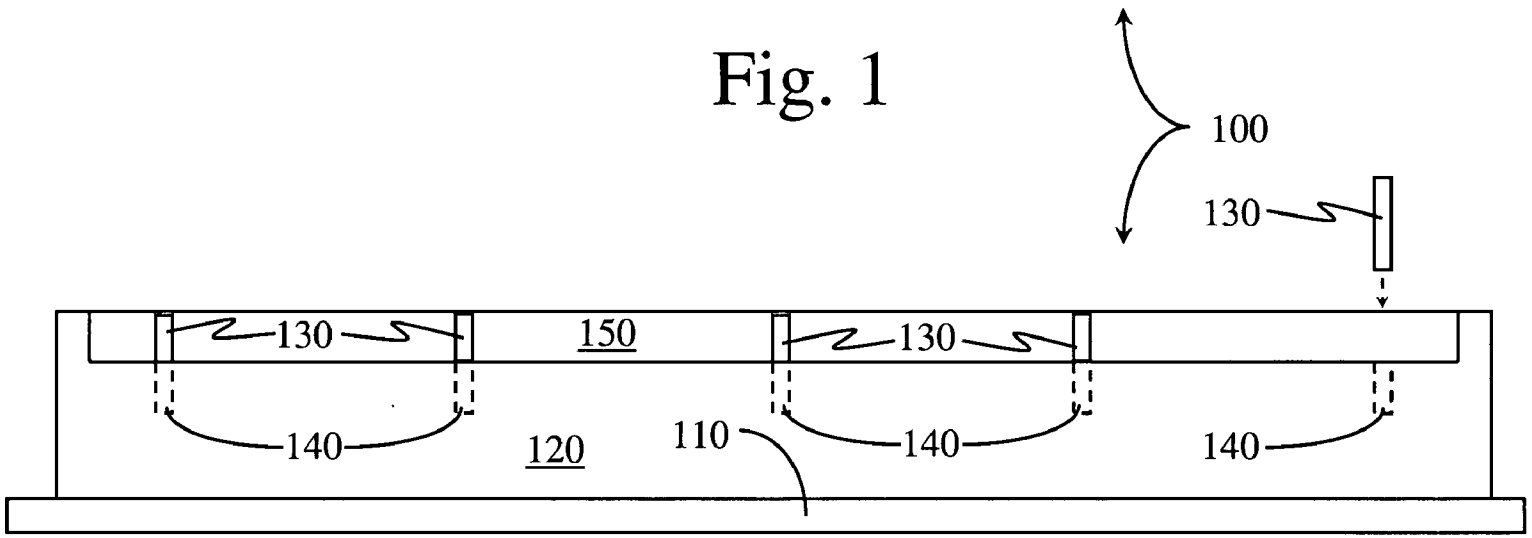
FIG. 2 is a side elevation view of the chair raiser having removable pegs.
Figure 3:
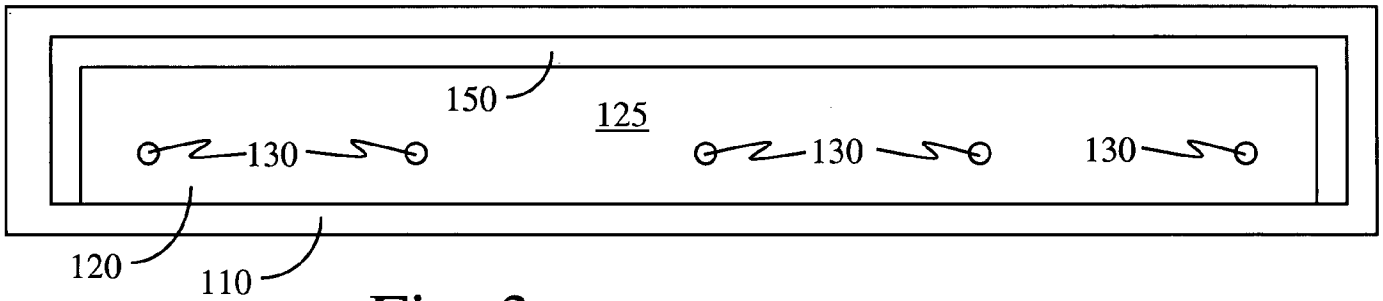
FIG. 3 is a top plan view of the chair raiser having removable pegs.

The chair raiser 100 of the present invention is shown in five views in FIGS. 1–4, and 6. A substantially broad, integral base 110 provides purchase for the chair raiser 100 on a floor or other horizontal surface. The chair raiser 100 gets its height from a raised portion 120 with a flat upper surface 125. The flat upper surface 125 is outfitted with a series of holes 140 of adequate diameter and depth to easily receive pegs 130. Three sides of the flat upper surface 125 are enclosed by a solid wall 150 in a first embodiment, and an outer series of pegs 600 (FIG. 6) in a second embodiment. In either embodiment, the enclosure 150, 600 is of sufficient height and strength to limit the travel of the chair's legs. In some cases, a chair's 500 (see FIG. 5) outer frame may rest on the enclosure 150, 600 rather than the chair's 500 legs having bearing on the flat upper surface 125.

Figure 7:
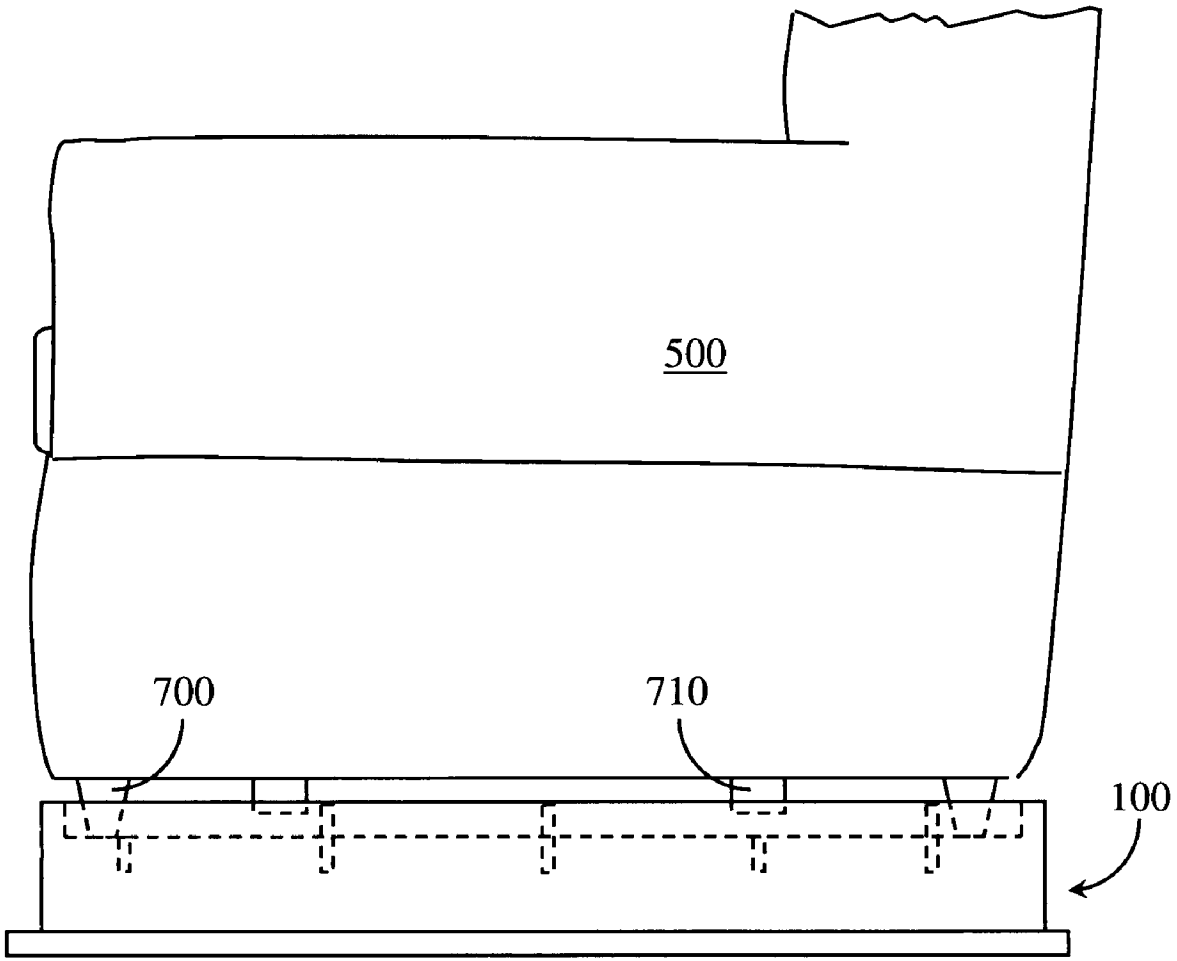
FIG. 7 is a side elevation view of the chair raiser in use under a chair or other furniture with appropriate pegs removed.

The pegs 140 are removable from the raised portion 120 of the chair raiser 100. Pegs 140 are selectively removed to allow room for the chair's 500 legs and transverse cross members. An example is shown in FIG. 7. One peg 140 has been removed to make room for a front leg 700. Another peg 140 has been removed to accommodate a rear transverse cross member 710. Other pegs 140 remain installed in the chair raiser 100.

Figure 5:
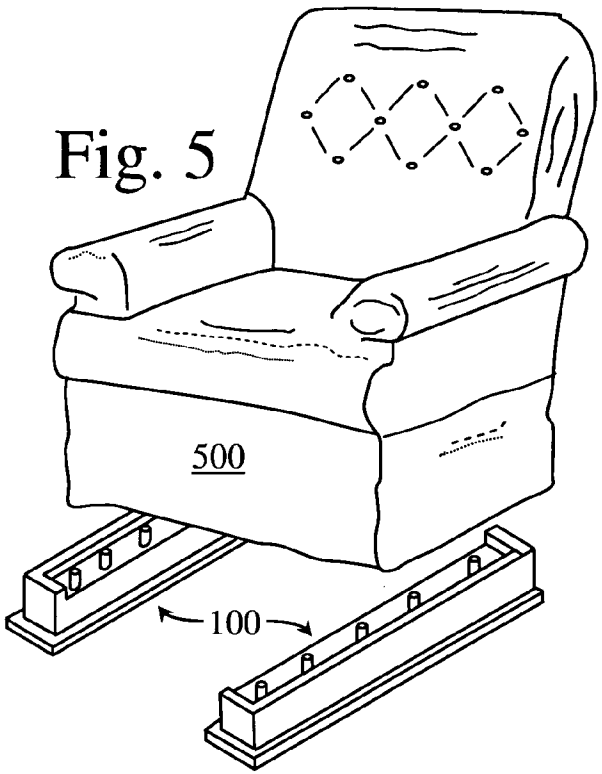
FIG. 5 is a perspective view of two chair raisers with a chair to be raised.
Figure 4:
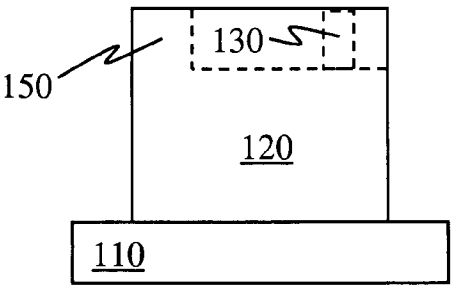
FIG. 4 is a side elevation view of the chair raiser having removable pegs.
Figure 6:
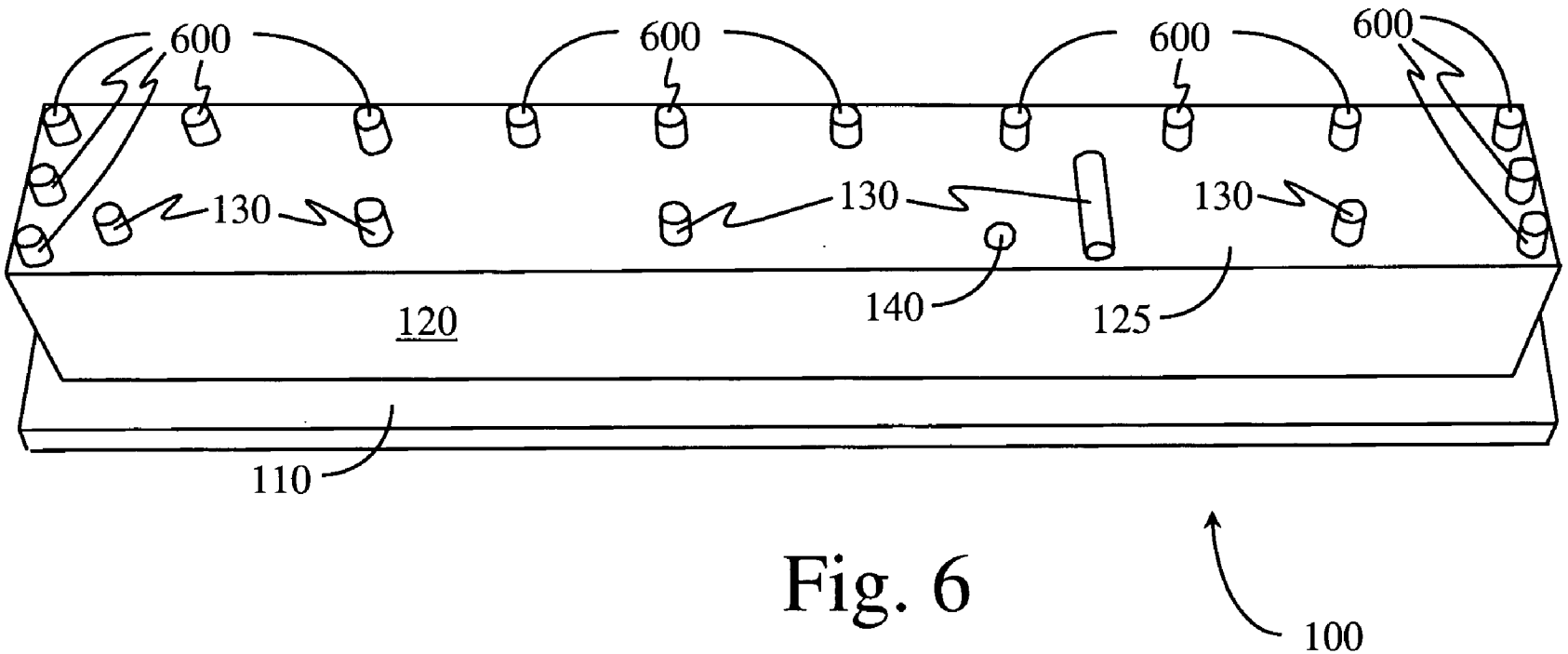
FIG. 6 is a perspective view of a second embodiment of the chair raiser of the present invention having pegs to enclose three sides of a flat surface.

A chair 500 is shown ready to lower onto two chair raisers 100 in FIG. 5. The furniture with which chair raisers 100 of the present invention may be used include kitchen chairs, overstuffed chairs, love seats, and sofas.

The above embodiments are the preferred embodiments, but this invention is not limited thereto. It is, therefore, apparent that many modifications and variations of the present invention are possible in light of the above teachings. It is, therefore, to be understood that within the scope of the appended claims, the invention may be practiced otherwise than as specifically described.

I claim:

1. An apparatus for elevating a chair, the apparatus comprising:

(a) a raised portion, operably engaging a floor on its lower surface;

(b) a flat surface on a top of the raised portion on which to operably set a chair's legs;

(c) enclosures on three sides of said flat surface to secure said chair's legs from sliding off the flat surface; and (d) removable pegs operably inserted into the raised portion.

2. The apparatus of claim 1 wherein said enclosures on three sides of the flat surface are comprised of solid walls on three sides of the flat surface.

3. The apparatus of claim 1 wherein said enclosures on three sides of the flat surface are comprised of additional pegs located substantially on three sides of the flat surface.

4. The apparatus of claim 3 wherein at least some of said additional pegs are removable.

5. The apparatus of claim 3 wherein said additional pegs are not removable.

6. The apparatus of claim 1 wherein a material comprising said apparatus is wood.

7. The apparatus of claim 1 wherein a material comprising said apparatus is plastic.

8. The apparatus of claim 1 wherein a material comprising said apparatus is metal.

9. A method for elevating a chair to assist handicapped persons in exiting the chair, the method using a chair raising device comprising a raised portion having a flat upper surface, the flat surface being enclosed on three sides and having holes into which pegs are operably inserted, the method comprising the steps of:

(a) operably resting legs of the chair on the flat upper surface of the raised portion inside the enclosed three sides; and (b) removing any pegs disallowing the chair's legs to engage the flat upper surface due to their obstruction of any part of the chair.

10. The method of claim 9 wherein the peg is removed to accommodate a chair leg.

11. The apparatus of claim 9 wherein the peg is removed to accommodate a chair transverse cross member.

12. The method of claim 9 wherein the legs of the chair are placed on the flat upper surface, one at each end of said flat upper surface.

* * * * *